US006826859B1

(12) United States Patent
Lin

(10) Patent No.: US 6,826,859 B1
(45) Date of Patent: Dec. 7, 2004

(54) DECORATIVE SHADE FOR A VIDEO DISPLAY

(76) Inventor: Jui-Ching Lin, No. 37, Lane 557, Chungcheng Rd., Wufeng Hsiang, Taichung Hsien (TW)

( * ) Notice: Subject to any disclaimer, the term of this patent is extended or adjusted under 35 U.S.C. 154(b) by 0 days.

(21) Appl. No.: 10/721,245

(22) Filed: Nov. 26, 2003

(51) Int. Cl.[7] ..... G09F 11/18; B41J 11/02
(52) U.S. Cl. ..... 40/514; 160/24; 248/918
(58) Field of Search ..... 40/514; 248/918; 160/24, 26, 182, 31

(56) References Cited

U.S. PATENT DOCUMENTS 1,759,619 A * 5/1930 Hutchinson, Jr. ..... 126/544
1,913,961 A * 6/1933 Shape ..... 296/97.7
1,963,404 A * 6/1934 Dixson ..... 160/31
5,499,793 A * 3/1996 Salansky ..... 248/442.2
5,671,790 A * 9/1997 Andersen et al. ..... 160/24
6,188,450 B1 * 2/2001 Coons ..... 348/841

* cited by examiner

*Primary Examiner*—Cassandra Davis
(74) *Attorney, Agent, or Firm*—Fei-Fei Chao; Bingham McCutchen LLP

(57) ABSTRACT

A decorative shade for a video display with a screen has a window with an opening to attach to the video display in front of the screen on the video display, a rolling device mounted inside the window and a blind wound on the rolling device to selectively cover the screen. Wherein, the window can be mounted detachably on the video display or formed integrally on the video display. The blind selectively winds onto or off the rolling device to open or cover the screen. When the blind covers the screen, the decorative shade protects and keeps dust off the video display. Furthermore, the window has a decorative appearance, and a picture on the blind imitates a piece of artwork. Thereby, the video display is changed into an artistic decoration.

13 Claims, 8 Drawing Sheets

DECORATIVE SHADE FOR A VIDEO DISPLAY

BACKGROUND OF THE INVENTION

1. Field of the Invention

The invention relates to a decorative shade for a video display, and particularly to a decorative shade for a video display, which has artistic features to decorate the video display.

2. Description of Related Art

Video displays are common in households and include computer monitors, televisions and video game monitors. However, the appearance of a computer monitor or a television not in use is a monotonous frame and a dark, blank screen. Therefore, the video display does not have any decorative features when the video display is not used. With video display trends tending toward thin, very large video displays, large-size plasma televisions and liquid crystal displays (LCD) over 40-inches in size have been created and are becoming common. As such, video displays are becoming a larger visual proportion for interior decoration, and the monotonous appearance of video displays is a drawback that most consumers have no choice but to accept.

Additionally, the plasma televisions and the liquid crystal displays are often suspended at high places so they are not easily cleaned. Furthermore, screens on liquid crystal displays are soft and easily damaged. Therefore, a protective, dust-proof device must be used with large-size or pliable video displays such as plasma televisions or liquid crystal displays, respectively.

The present invention has arisen to provide a decorative shade for a video display to provide dust-proof protection and artistic features at the same time.

SUMMARY OF THF INVENTION

A first objective of the present invention is to provide a decorative shade for a video display, which has artistic features to decorate the video display.

A second objective of the present invention is to provide a decorative shade for a video display that provides dust-proof protection for the video display.

Further benefits and advantages of the present invention will become apparent after a careful reading of the detailed description in accordance with the drawings.

DETAILED DESCRIPTION OF THE PREFERRED EMBODIMENT

A decorative shade for a video display with a screen comprises a window with an opening to mount to the video display, a rolling device mounted inside the window, and a blind mounted on the roller. The window is either detachably mounted on the video display or integrally formed on the video display.

Figure 1:
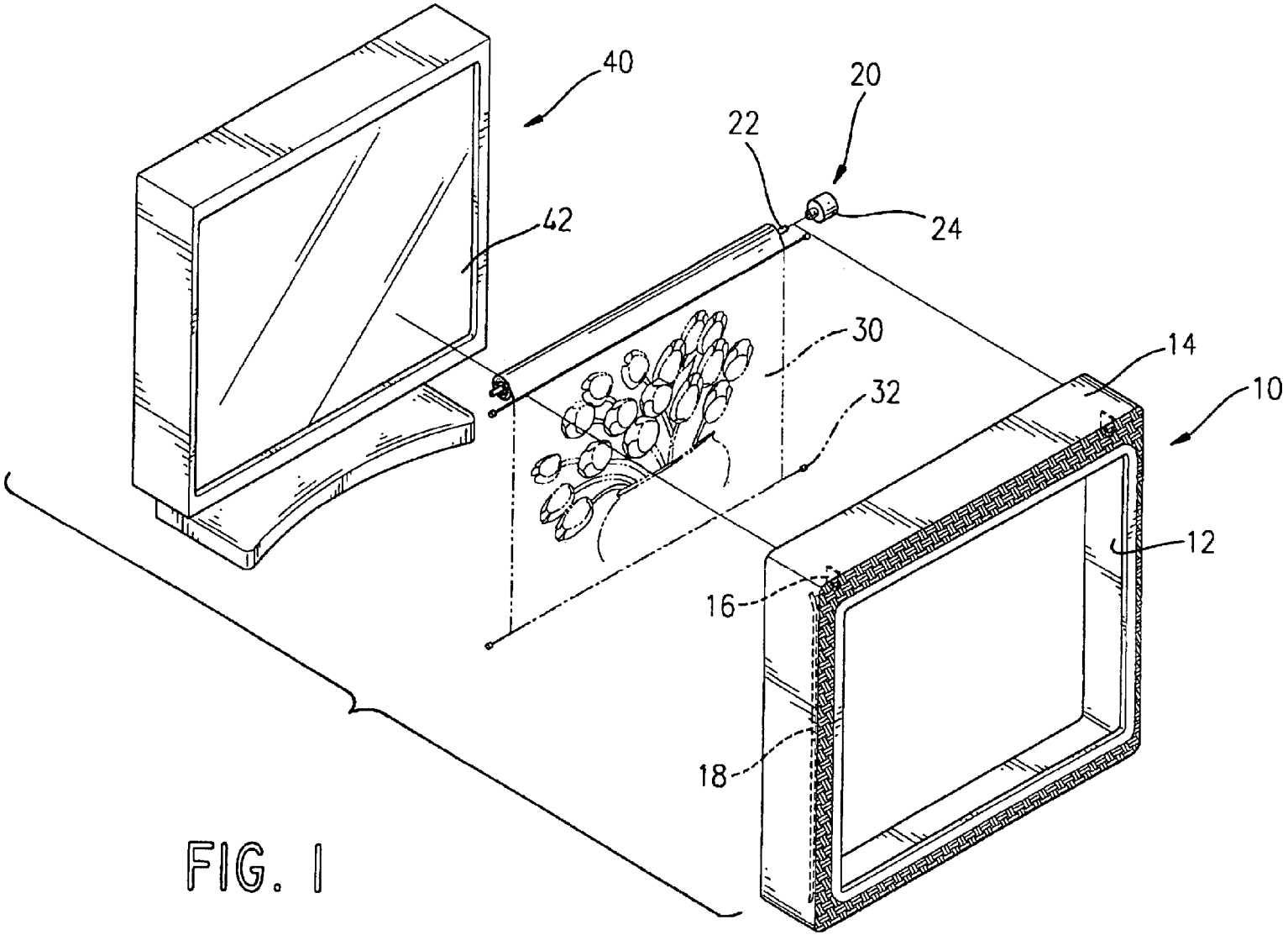
FIG. 1 is an exploded perspective view of a first embodiment of a decorative shade for a video display in accordance with the present invention.
Figure 2:
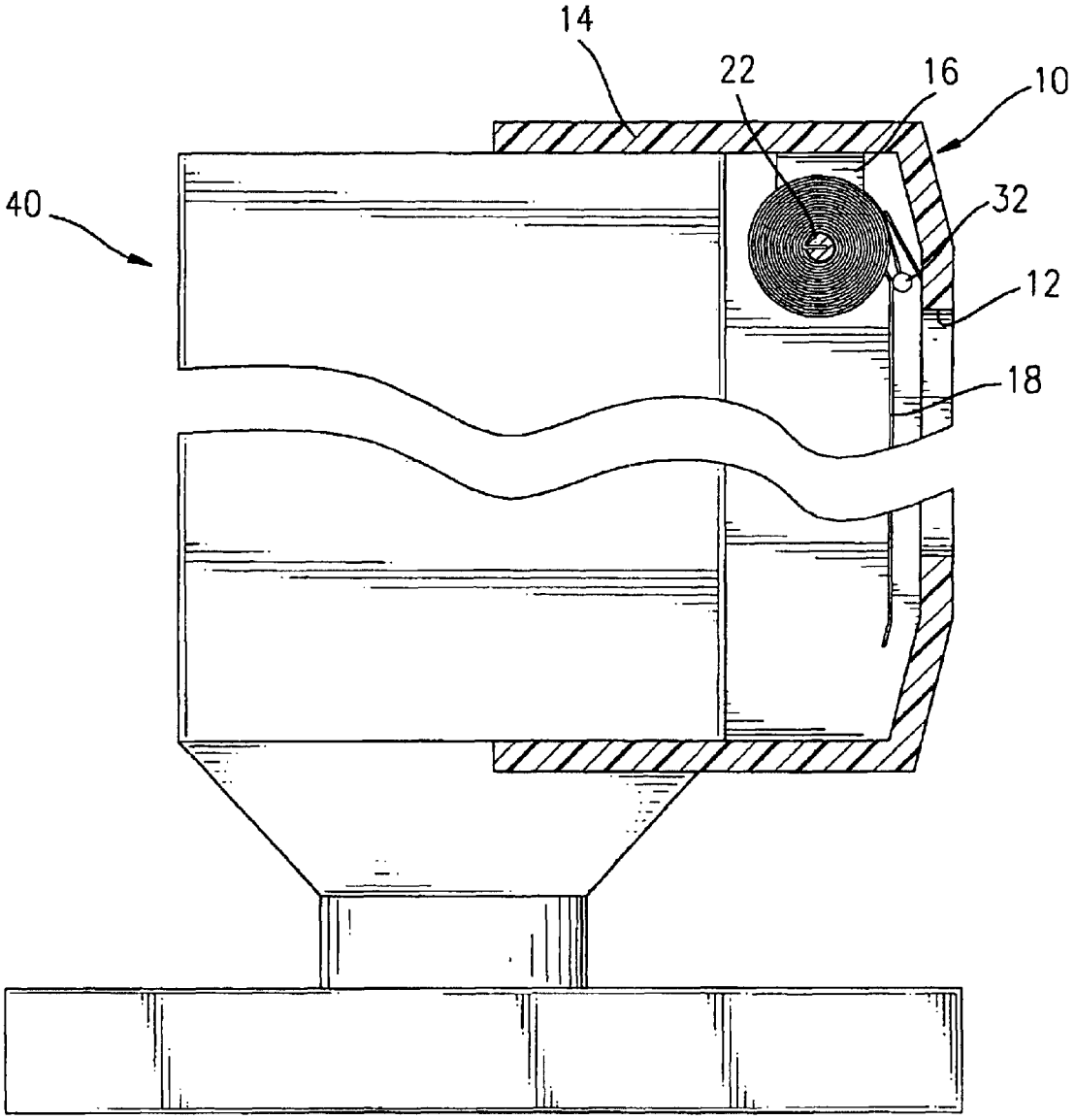
FIG. 2 is a side plan view in partial section of the decorative shade in FIG. 1 mounted on a video display.

With reference to FIGS. 1 and 2, a first embodiment of the decorative shade in accordance with the present invention comprises a window (10), a rolling device (20), and a blind (30).

The window (10) is a rectangular frame and has a front face (not numbered), a rear face (not numbered), a rectangular opening (12) and a flange (14). The front face of the window (10) has specific patterns or embossments to make the window (10) look like a frame for a painting. The front and rear faces have a common outer edge, and the flange (14) is formed around and extending from the outer edge of the rear face and has a top inner face (not numbered), a bottom inner face (not numbered), two inner side-faces (not numbered), two roller brackets (16) and two optional rails (18). When the window (10) is mounted on the video display (40), the opening (12) aligns with the screen (42). The top inner face has two ends (not numbered). The roller brackets (16) are mounted respectively at opposite ends of the top inner face. Each end bracket (16) has a hole that aligns with the hole in the other roller bracket (16). The rails (18) are mounted respectively on the two inner side-faces and guide the blind (30) when the blind (30) moves.

The rolling device (20) comprises a roller (22) and a driver (24). The roller (22) has two ends respectively penetrating the holes in the roller brackets (16). Thereby, the roller (22) is suspended at the top inner face of the window (10). The driver (24) is attached to one end to rotate the roller (22). The driver (24) may be either electrically or manually driven. Preferably, the driver (24) is electrically driven by a remote control.

The blind (30) wound on the roller (22) has an attached end (not numbered), a free end (not numbered), two side edges (not numbered), a weighted rod (32) and an outer surface (not numbered). The attached end is attached to the roller (22), and the free end is wound on or off the roller (22) to uncover or cover the opening (12) of the window (10). Because the roller (22) is rotated clockwise or counterclockwise by the driver (24), the blind (30) is wound off or onto the roller (22) to selectively cover or uncover the screen (42). The weighted rod (32) is attached to the free end and has two ends (not numbered). The ends of the weighted rod (32) extend respectively beyond the side edges of the blind (30) and are slidably mounted respectively in the rails (18). The weighted rod (32) pulls the blind (30) down and keeps the blind (30) flat. The outer surface of the blind (30) has a picture facing the opening (12) so the window looks like a painting or a decorative picture when the blind (30) covers the screen (42).

Figure 3:
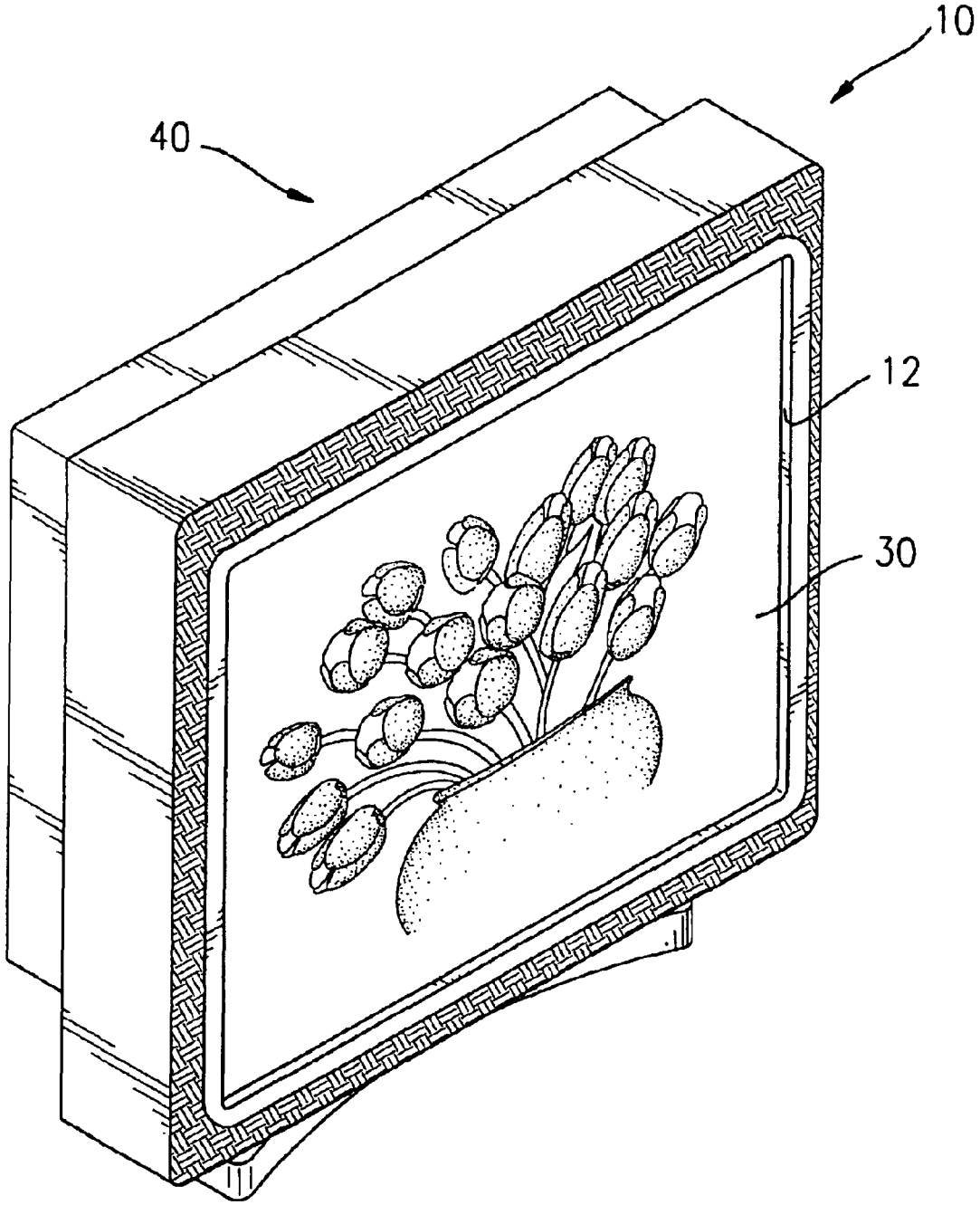
FIG. 3 is an operational perspective view of the decorative shade in FIG. 1 mounted on a liquid crystal display.

With further reference to FIG. 3, the decorative shade is attached to a video display (40) by pressing the rectangular flange (14) around the video display (40). When the video display (40) needs to be used, the blind (30) is wound up by the rolling device (20) to reveal the screen (42). When the video display (40) is not being used, the blind (30) is unwound to cover and protect the screen (42). The blind (30) also keeps the video display (40) free from dust. The patterns on the front face of the blind (30) transform the ii decorative shade to a framed piece of artwork. Thereby, the decorative shade changes a simple covered video display (40) to a decorative picture.

Figure 4:
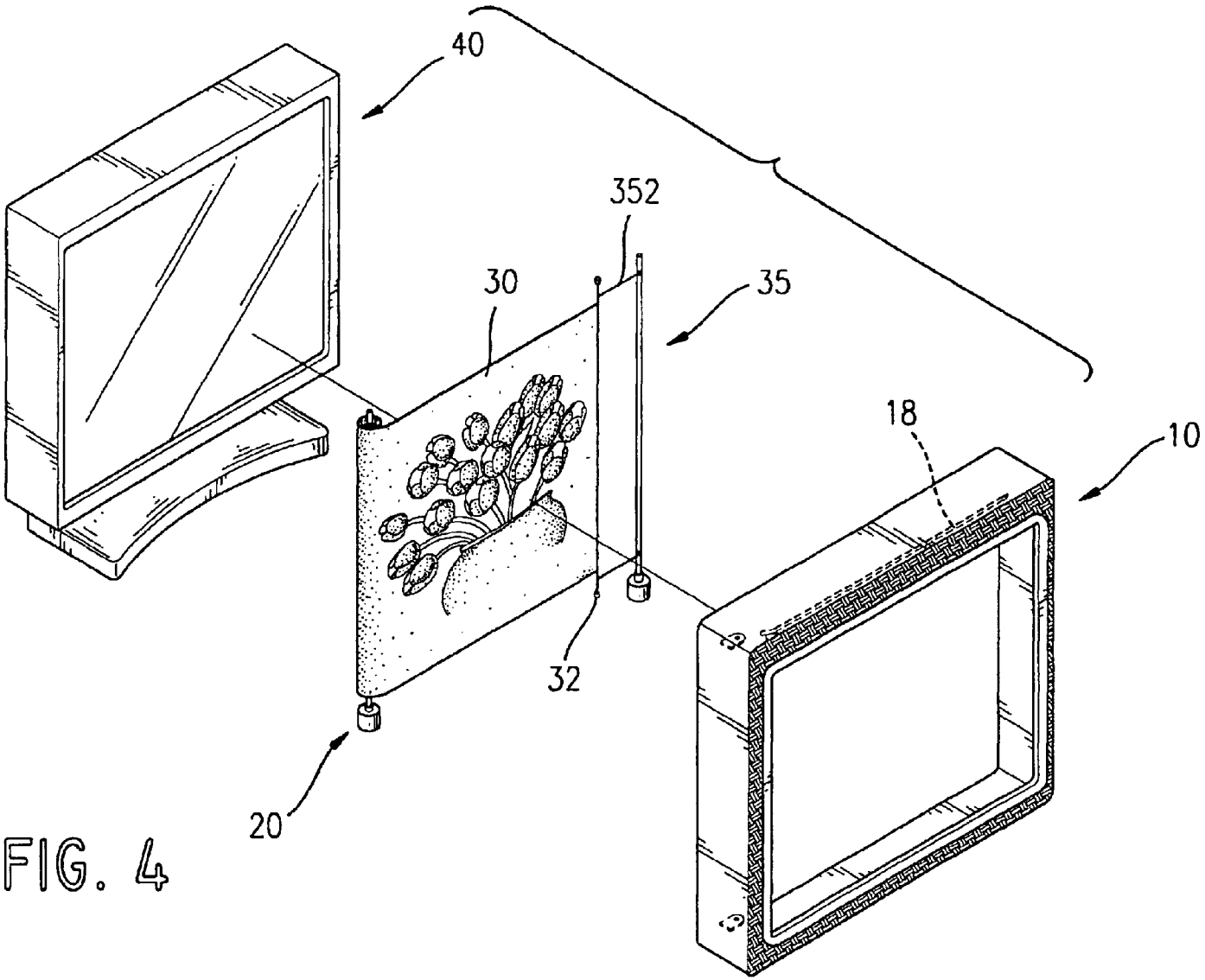
FIG. 4 is an exploded perspective view of a second embodiment of the decorative shade in accordance with the present invention with a blind that moves transversally.

With reference to FIG. 4, a second embodiment of the decorative shade in accordance with the present invention has a blind (30) that moves transversally inside the window (10). The rolling device (20) is mounted in one inner side-face of the flange (14). Since gravity will not pull the blind (30) over the video display, a closing device (35) is mounted the inner side-face of the flange (14) opposite to the rolling device (20). The closing device (35) has the same elements as the rolling device (20) including a roller (not numbered) and a driver (not numbered) plus two cords (352). The roller (22) has two ends (not numbered). The cords (352) are attached between the roller and the weighted rod (32) (or the blind cloth) respectively at the two ends to keep the blind (30) straight and flat. Preferably, the closing device (35) and the rolling device (20) are operated synchronously in the same rotating direction to extend or retract the blind (30).

Figure 5:
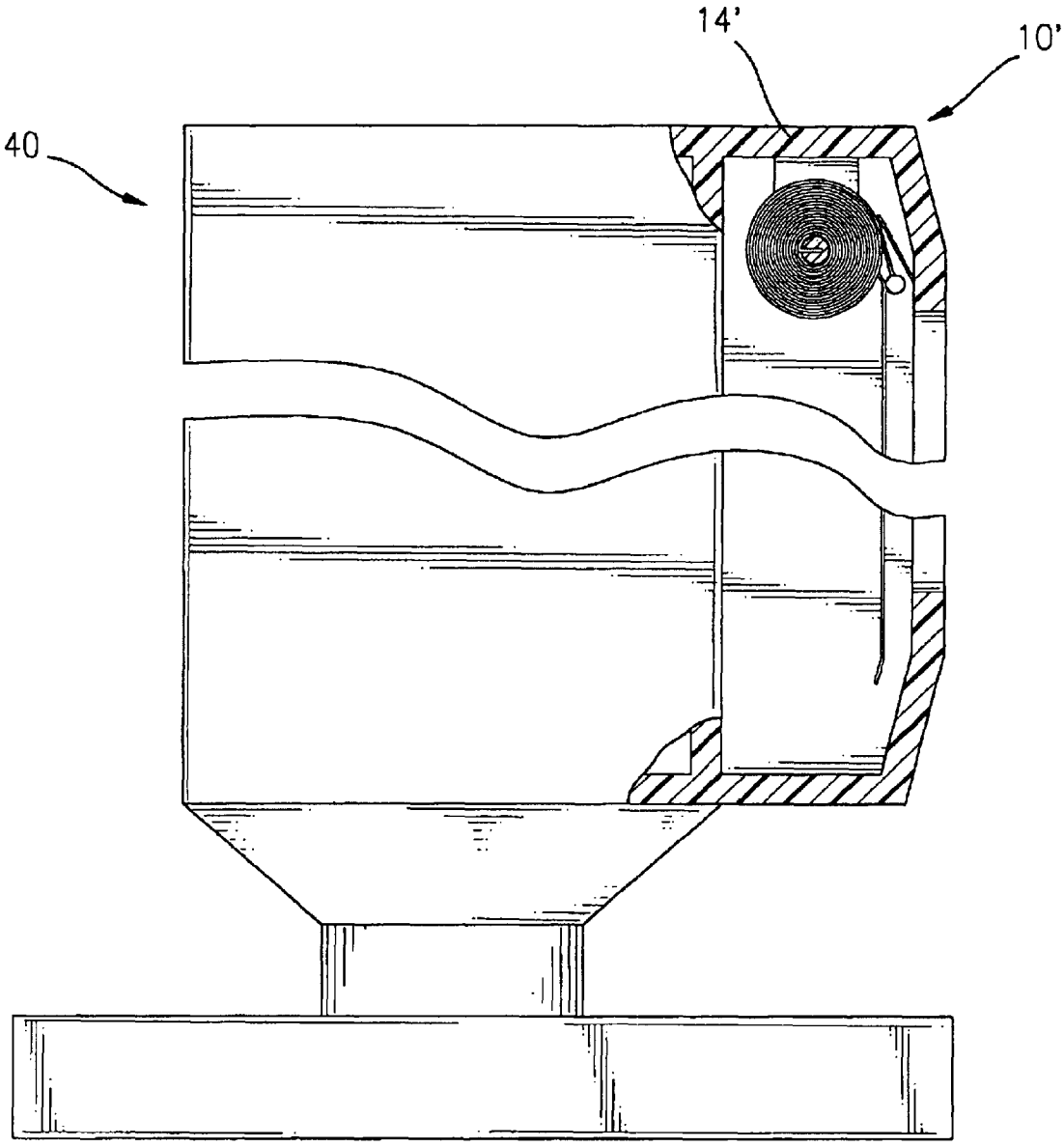
FIG. 5 is a side plane view in partial section of a third embodiment of the decorative shade in accordance with the present invention, wherein the shade is formed integrally with the video display case.
Figure 6:
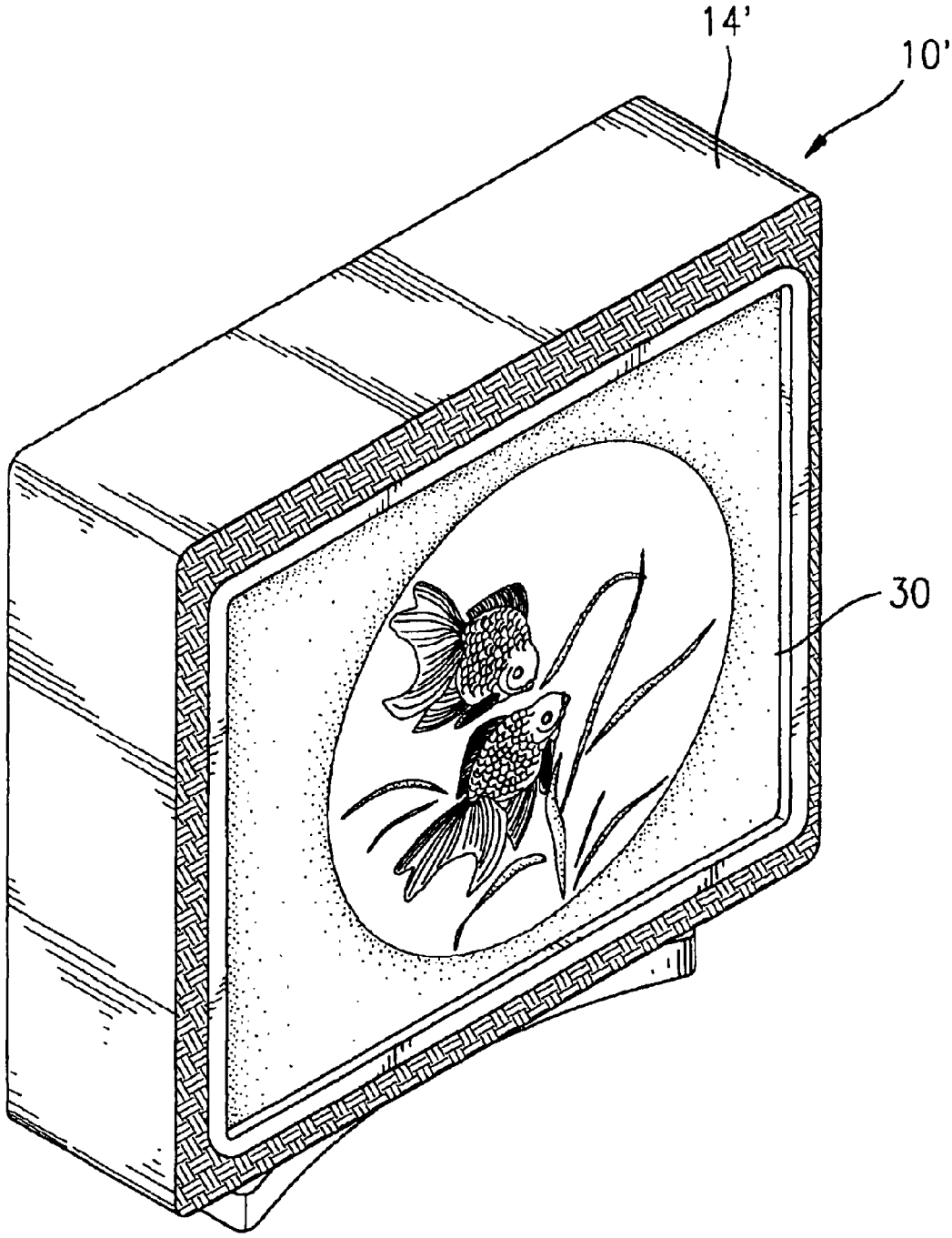
FIG. 6 is a perspective view of the third embodiment of the decorative shade formed on a liquid crystal display.
Figure 7:
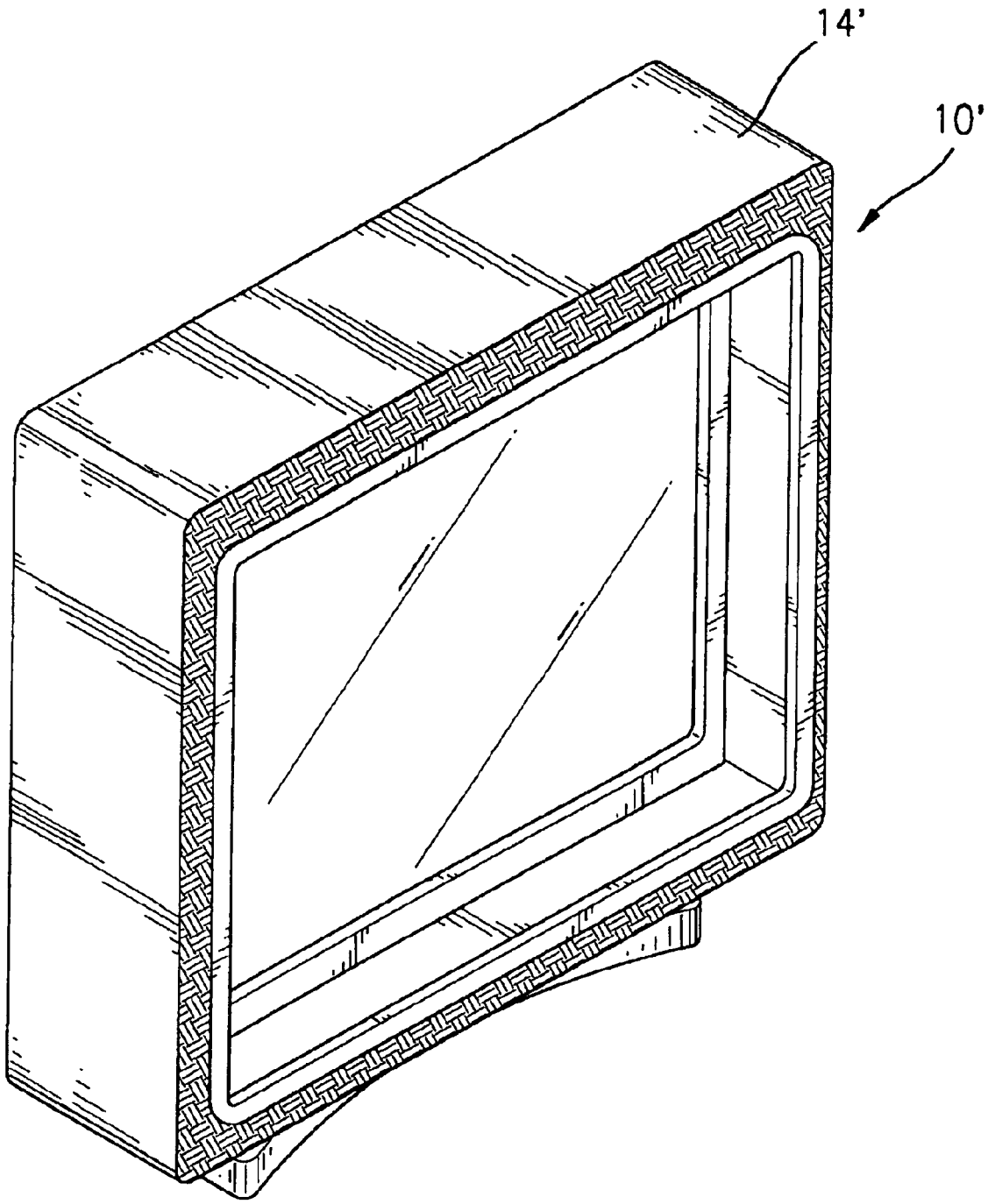
FIG. 7 is an operational perspective view of the third embodiment of the decorative shade with the blind retracted.

With reference to FIGS. 5 to 7, a third embodiment of the decorative shade in accordance with the present invention has a flange (14') of the window (10') formed integrally with the video display. Other elements in the third embodiment are the same as those in the first and the second embodiments. Therefore, further description would be redundant and is not included.

Figure 8:
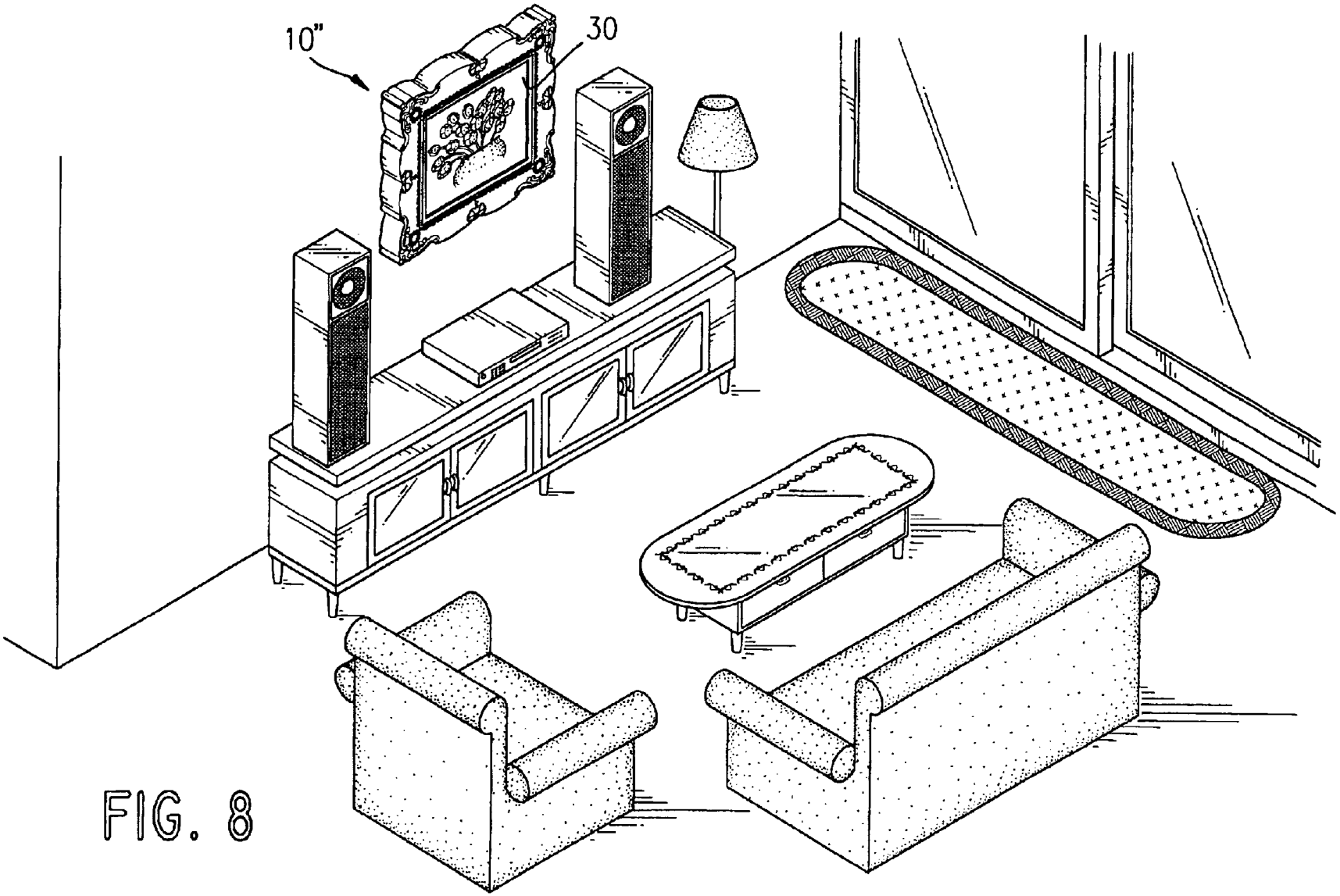
FIG. 8 is a perspective view of a living room with a video display that has a decorative shade.

With reference to FIG. 8, the window (10") of the decorative shade attached to a large-size plasma television not only protects and keeps dust off the plasma television but also changes the plasma television to a decorative picture.

Although the invention has been explained in relation to its preferred embodiment, many other possible modifications and variations can be made without departing from the spirit and scope of the invention as hereinafter claimed.

What is claimed is:

1. A decorative shade for a video display that has a screen, the decorative shade comprising:

a window (10) being a rectangular frame and having an opening (12) that is adapted to align with the screen when the window (10) is mounted on the video display;

a front face with an outer edge;

a rear face with an outer edge common to the front face;

a flange (14) formed around and extending from the outer edge of the rear face, wherein the flange (10) has multiple inner faces having a top inner face, a bottom inner face and two inner side-faces, wherein the flange is adapted to surround the exterior of the video display;

a rolling device (20) attached to one of the inner faces and comprising a roller (22) and a driver (24) attached to the roller (22) to rotate the roller (22); and a blind (30) wound on the roller (22) and having an attached end attached to the roller (22), a free end and an outer face with a picture.

2. The decorative shade as claimed in claim 1, wherein the window (10) has two roller brackets (16) respectively attached to the top inner face; and two holes respectively defined in the two roller brackets (16) and aligning with each other;

wherein the roller (22) has two ends penetrating respectively the two holes in the roller brackets (16).

3. The decorative shade as claimed in claim 2, wherein the driver (24) is electrically driven.

4. The decorative shade as claimed in claim 3, wherein the driver (24) is electrically driven with a remote control.

5. The decorative shade as claimed in claim 2, wherein the driver (24) is manually driven.

6. The decorative shade as claimed in claim 2, wherein blind (30) further has a weighted rod (32) attached to the free end.

7. The decorative shade as claimed in claim 1, wherein the driver (24) is electrically driven.

8. The decorative shade as claimed in claim 1, wherein the driver (24) is manually driven.

9. The decorative shade as claimed in claim 1, wherein blind (30) further has a weighted rod (32) attached to the free end.

10. The decorative shade as claimed in claim 1, wherein decorative shade further has a closing device (35) attached to one of the inner faces on the flange (14) opposite to the rolling device (20).

11. The decorative shade as claimed in claim 1, wherein the window (10) has two roller brackets (16) attached to one of the inner side-faces; and two holes respectively defined in the two roller brackets (16) and aligning with each other;

wherein the roller (22) has two ends penetrating respectively the two holes in the roller brackets (16).

12. The decorative shade as claimed in claim 11, wherein decorative shade further has a closing device (35) attached to the other inner side-face on the flange (14) opposite to the rolling device (20).

13. The decorative shade as claimed in claim 12, wherein the closing device (35) comprises a roller;

a driver attached to the roller to rotate the roller; and two cords (352) attached between the roller and the blind (30) respectively at ends to keep the blind (30) straight and flat.

* * * * *